United States Patent [19]

Apissomian

[11] 4,456,301

[45] Jun. 26, 1984

[54] FURNITURE CONSTRUCTION

[75] Inventor: Arthur A. Apissomian, Wadena, Minn.

[73] Assignee: Homecrest Industries Incorporated, Wadena, Minn.

[21] Appl. No.: 293,372

[22] Filed: Aug. 17, 1981

[51] Int. Cl.[3] ..... A47C 7/00

[52] U.S. Cl. ..... 297/445; 297/452; 297/441

[58] Field of Search ..... 297/445, 452; 160/327, 160/383, 371, 400; 5/186 R, 191, 189, 207, 190

[56] References Cited

U.S. PATENT DOCUMENTS

| | | | |
|---|---|---|---|
| 2,156,664 | 5/1939 | Litle, Jr. | 5/190 |
| 2,995,182 | 8/1961 | Hendrickson | 297/445 |
| 3,724,402 | 4/1973 | Thyberg et al. | 160/371 |
| 3,751,110 | 8/1973 | Shaw | 297/445 |

FOREIGN PATENT DOCUMENTS

| | | | |
|---|---|---|---|
| 444455 | 3/1936 | United Kingdom | 5/190 |

*Primary Examiner*—Francis K. Zugel
*Attorney, Agent, or Firm*—Kinney & Lange

[57] ABSTRACT

A furniture construction includes a plurality of flexible closed loop plastic sections of webbing stretched across a pair of spaced-apart rigid frame members. A plurality of outwardly extending retaining ears positioned in opposing pairs extend outwardly from and are rigidly attached to each frame member. The ends of each closed loop section of webbing are hooked over a pair of opposing ears extending the webbing between the frame members providing a support surface therebetween. The ears are positioned along the frame members such that the ears forms an angle in the approximate range of 135° to 340° with a plane formed by the frame members.

2 Claims, 6 Drawing Figures

FURNITURE CONSTRUCTION

BACKGROUND OF THE INVENTION

1. Field of the Invention

The present invention relates to furniture construction, and in particular, it relates to furniture construction that includes flexible plastic webbing for a support surface.

2. Description of the Prior Art

Many items of furniture, particularly chairs, have extending sections of flexible webbing extending in between opposing frame elements of a frame for providing a support surface. This type of construction provides a yieldable support surface which is attractive and may be readily cleaned. A great problem, however, in connection with such webbing is that of securing the webbing to the frame members in a quick and inexpensive manner. In addition, it is very desirable that the webbing not slip with respect to the frame and remain as a taut supporting surface. The use of rivets, screws, or other similar fastening devices is undesirable since the fastening devices typically create holes in the webbing which enlarge and eventually tear the webbing.

There are also other arrangements which secure a webbing to a frame without the use of fastening devices which require holes in the webbing. One such arrangement is shown in the Dubinsky Pat. No. 3,590,901. In the Dubinsky Patent, a webbing is first strung on a temporary jig and then removed and applied over the frame of the chair. This method of attaching webbing to a chair is rather complicated. Another arrangement is illustrated in the Bottemiller Pat. No. 3,771,583, which is assigned to the same assignee as the present invention. In this arrangement, plastic webbing is heated so that the webbing will stretch and then wound around spaced-apart opposing frame members so that the ends of the webbing are doubled back so as to be overlapping and hence secured thereto. Upon cooling, the webbing will return to its original length placing the webbing in a taut position between the frame members.

SUMMARY OF THE INVENTION

The present invention includes a simple construction for securing plastic webbing to a furniture frame, preferably a chair frame. A plurality of outwardly extending ear members positioned in opposing pairs extend outwardly from a pair of spaced-apart members with one ear member of each pair rigidly attached to each opposing frame member. The flexible webbing is in the form of a closed loop having a pair of loop end portions and a middle portion therebetween defining two webbing strips that extend between the frame members. The ears are positioned on the frame members in an approximate angular range of 135° to 340° Both loop portions are stretched over the opposing ear members, retaining the flexible webbing in place and in tension.

A plurality of closed loop webbing sections are secured to the chair frame by placing one loop end portion over an ear member and slightly stretching the webbing across the frame and slipping the other loop end portion over the opposing ear member. This manner of attachment is repeated over the entire chair construction and provides a yieldable support surface.

DETAILED DESCRIPTION OF THE PREFERRED EMBODIMENTS

Figure 1:
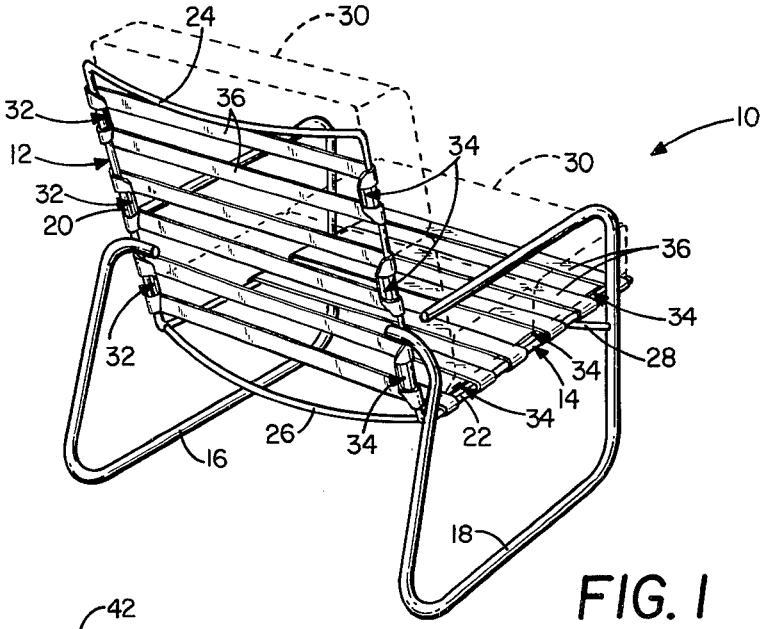
FIG. 1 is a perspective view of a chair employing the furniture construction of the present invention in both the seat and back portion of a chair.

In FIG. 1, there is shown a chair, generally indicated at 10, using the construction of the present invention. The chair 10 in FIG. 1 includes a typical frame construction having a back portion 12, a seat portion 14, rigidly connected to each other and supported from the ground by some type of base. In the embodiment shown in FIG. 1, the base includes leg members 16 and 18, however, any type of base is includable within the spirit of the present invention.

The chair 10 includes two cylindrical side frame members 20, 22, shown in the form of rods, that are suitably bent to define the back portion 12 and a seat portion 14. The frame members 20, 22 are held in a relatively fixed space relationship to each other by a plurality of cross members 24, 26, and 28. The frame members 20 and 22 and the cross member 24 maybe formed of a continuous tubing member bent to form the side frame members 20 and 22 and the cross members 24. Cross members 26 and 28 may be rigidly secured to side frame members 20 and 22 in any suitable manner as by welding.

Figure 6:
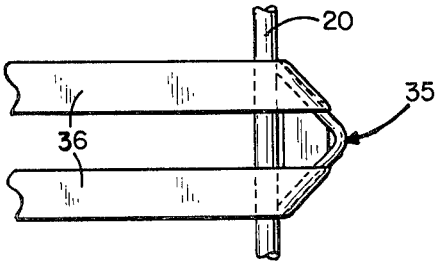
FIG. 6 is another alternative embodiment in which the retaining ears are triangular in configuration.

A plurality of outwardly extending retaining clip members 32, 34 are rigidly attached to the frame members 20, 22 respectively, in any suitable manner as by welding The ear members 32, 34 are positioned in opposing pairs in substantially the same planes along the back and seat portions 12, 14. The opposing ear members 32, 34 are substantially similar in configuration and will be subsequently referred to as 34 in FIGS. 2–4. The ear member 34 is preferably a U-shaped ear member. Other configurations are also contemplated such as a substantially triangular configuration 35, as illustrated in FIG. 6.

Figure 2:
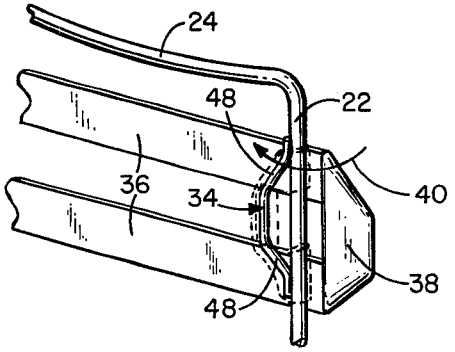
FIG. 2 is a fragmentary perspective view of the loop end of the closed loop webbing being positioned so as to be readily placed over a retaining ear member as viewed from the rear of the chair.

A plurality of closed loop sections of flexible webbing 36 are strung between the frame members 20, 22. Each loop section of webbing 36 has two loop ends with each loop end being hooked over the ear member 34, as illustrated in FIG. 2. Preferably, the loop sections of webbing are made of a flexible polyvinylchloride which is initially heated before application to facilitate stretching between the frame members 20, 22. First, one loop end 38 is hooked over one of the ear members 34, and over the frame member 22 and the other loop end is placed over the other frame member and hooked over the opposing ear member. The webbing is allowed to cool and contract producing a taut but yieldable support surface between the two opposing frame members 20, 22 such that a cushion 30 (not shown) may be supported thereon, as illustrated in dotted lines in FIG. 1.

Figure 4:
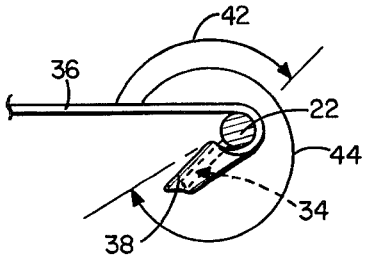
FIG. 4 is a cross sectional view showing the possible range of angular placement of the retaining clip members about a frame member.
Figure 5:
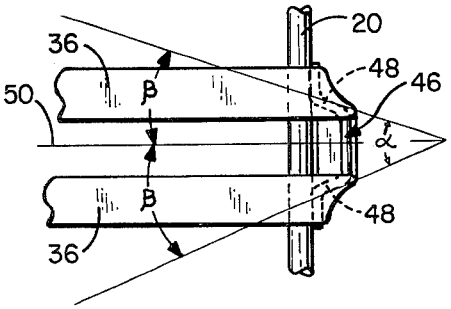
FIG. 5 is an alternative embodiment in which the retaining ears extend forwardly instead of rearwardly.
Figure 3:
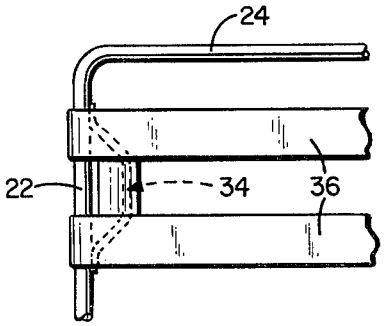
FIG. 3 is a fragmentary front view similar to that of FIG. 2 but viewed from the front of the chair and with the webbing actually extending over the ear.

The retaining ear members may be positioned in a wide range of angular positions with respect to the plane of the frame formed by the side member 20 and 22, as illustrated in FIG. 4. The retaining ear members 34 can be positioned from approximately an angle of 135°, as indicated by arrow 42, to approximately an angle of 340°, as indicated by arrow 44, and still ensure proper functioning of the retaining ear member in retaining the webbing 36 in position. An embodiment with the ear member 34 forming an angle approximately 340° with a plane formed by the frame members is shown in FIGS. 1–3. When positioned in such a manner, the ear member and loop end of the looped webbing are hidden from view when the cushion 30 is placed on the chair, as illustrated in FIGS. 1 and 3. An angle of approximately 340° positions the ear members on the rearside of the back portion and the underside of the seat portion. An alternative embodiment with a retaining ear member 46 positioned in approximately a 135° position with respect to the plane of the frame members is illustrated in FIG. 5. When positioned at an angle of approximately 135°, the ear members extend toward the front of the chair from the back portion and upwardly from the seat portion.

The preferred angular range for positioning the ear members is approximately 270° to 330°. This range positions the ears on the back of the chair section and on the underside of the seat section hiding the ear members from view when the cushion is placed on the chair. In addition, the sections of flexible webbing are more easily attached to the ear members when the ears are in the preferred angular range.

Preferably, the ear members have an included angle $\alpha$ of 45° formed by side edge portions 48 such that an angle $\beta$ of approximately 22.5° is formed along a center line 50 of each closed loop of webbing. However, other configurations of the retaining ear members that suitably hold the looped webbing in a retaining position are within the spirit of the present invention.

The furniture construction of the present invention offers several distinct advantages.

1. The closed loop of webbing facilitates parallel positioning of the webbing between the frame members.
2. The retaining ear members hold the closed loop of webbing without perforating or puncturing the webbing at any point.
3. The webbing can be removed of secured to the frame members without the use of mechanical fasteners.
4. The retaining ear members may be varied in position along the frame members without effecting the retention of the webbing.
5. The retaining ear members can be positioned in a wide range of angular positions with respect to the webbing and still function properly in retaining the webbing in place.
6. The retaining ear members can be of a variety of configurations and still function properly.
7. The retaining ear members cannot be removed from the frame and thus cannot be lost and are reuseable in securing replacement webbing.

While the ear members and closed loop sections of webbing have been described in connection with a chair, other types of furniture are also contemplated. In general, although the present invention has been described with reference to the preferred embodiment, persons skilled in the art will recognize that changes may be made in form and detail without departing from the spirit and scope of the present invention.

What is claimed is:

1. A furniture construction comprising:

a pair of spaced-apart frame members;

means for holding the frame members in a relatively fixed spaced relationship;

a plurality of closed loop sections of flexible plastic webbing, each having a pair of loop end portions and a middle portion therebetween; and a plurality of opposing pairs of outwardly extending ear members, each having spaced-apart side edge portions with the ear members extending outwardly from and regidly attached to each frame member and each ear member being positioned on the frame members in an approximate angular range of 135° to 340° with a plane formed by the frame members, the side edge portions of each ear member being inclined inwardly toward their extremities and having such extremities spaced apart a distance substantially equal to the overall width of the loop section so as to position the flexible webbing in a flat relationship with respect to the plane formed by the frame members and with the middle portions of each loop section parallel to each other when the loop end portions of the flexible webbing are stretched over the side edge portion of the ear members placing the middle portions in tension.

2. The construction of claim 1 wherein the ear members are positioned on the frame members in an approximate angular range of 270° to 330° with the plane formed by the frame member.

* * * * *